United States Patent [19]

Moe et al.

[11] 4,249,336

[45] Feb. 10, 1981

[54] CONSTRUCTION TOY

[76] Inventors: Walter Moe, 13039 Sky Valley Rd., Los Angeles, Calif. 90049; Charles M. Diker, 944 Fifth Ave., New York, N.Y. 10021; Lawrence A. Bernstein, P.O. Box 4096 (Malibu), Los Angeles, Calif. 90265

[21] Appl. No.: 126,954

[22] Filed: Mar. 3, 1980

[51] Int. Cl.[3] ..... A63H 33/04

[52] U.S. Cl. ..... 46/17; 40/155; 248/448

[58] Field of Search ..... 46/16, 17, 25; 248/448, 248/449, 460, 463; 35/27 R, 35 H; 273/157 R; 40/152.1, 155

[56] References Cited

U.S. PATENT DOCUMENTS

| | | | |
|---|---|---|---|
| 1,087,207 | 2/1914 | Austin | 35/27 |
| 2,032,872 | 3/1936 | Friedrichs | 248/449 |
| 2,424,168 | 7/1947 | Hoffman | 35/35 H |
| 2,526,527 | 10/1950 | Zander | 248/463 |
| 2,900,742 | 8/1959 | Barker et al. | 35/35 H |
| 2,912,203 | 11/1959 | Townsend | 248/448 |
| 3,696,548 | 10/1972 | Teller | 46/25 |
| 3,877,170 | 4/1975 | Bakker | 46/25 X |

FOREIGN PATENT DOCUMENTS

| | | | |
|---|---|---|---|
| 60919 | 2/1955 | France | 46/16 |
| 1256070 | 2/1961 | France | 46/25 |
| 1263303 | 5/1961 | France | 46/25 |
| 106261 | 5/1917 | United Kingdom | 273/157 R |
| 514690 | 11/1939 | United Kingdom | 273/157 R |

*Primary Examiner*—F. Barry Shay
*Attorney, Agent, or Firm*—Reagin & King

[57] ABSTRACT

A novel construction toy includes at least one substantially planar sheet containing a printed pattern on its surface; a plurality of colored interstacking blocks capable of intercoupling, such as frictionally interlocking, with one another to form a pattern corresponding to the pattern printed on said sheet; an elongate grid block capable of intercoupling with said blocks, and a support structure for holding said grid block and said pattern sheet with the latter in a position underlying said grid block; which support structure includes a first elongated member containing a first planar surface and a second planar surface recessed from said first to define a ledge; means for mounting the grid block in a position on said first member so as to protrude into a position overlying said second recessed surface and thereby define a channel for receiving an edge of the sheet; and a second member coupled to said first member for holding the sheet member from said other end; whereby said intercoupling blocks may be built up upon said grid block to the pattern depicted on said underlying sheet.

11 Claims, 8 Drawing Figures

CONSTRUCTION TOY

The present invention is directed to construction toys for children and, more particularly, to an improvement in that class of toys which employs interlocking block-like structures.

BACKGROUND OF THE INVENTION

Construction building block types of toys, comprising blocks which may be easily coupled together to form two or three dimensional structures, are well known, such as is evident from the exemplary patents U.S. Pat. No. 349,646 to Grigg; U.S. Pat. No. 879,455 to Frost; U.S. Pat. No. 2,861,388 to Favaretto; and U.S. Pat. No. 3,032,919 to Amsler, as well as in the widely marketed "Lego" brand constructional block type toy. Those who are parents of young children are aware that these toys are usually accompanied by a booklet or other brochure depicting various constructions, such as buildings, airplanes, and the like, in order to guide the child in his constructional activity. Beyond that, the child may use his own imagination in the construction of various figures and structures. It is appreciated that some of these exemplary models depicted in the instructions may be difficult for children of very young years to interpret and follow.

A principal object of the present invention is to provide a constructional toy using intercoupled blocks for easy and stable stacking with instructions in an arrangement which is easier for children of very young years to follow. An ancillary object of the invention is to provide the new type of constructional toy in which the resultant assembly may be displayed by the child on an incorporated easel-like arrangement or, alternatively, hung from a wall in a picture-like arrangement.

SUMMARY OF THE INVENTION

According to the invention, there is provided a variety of building blocks, each of which is capable of intercoupling with the other blocks of the set; an elongate grid block, capable of intercoupling with the aforesaid blocks; at least one essentially two-dimensional sheet, such as cardboard, containing a printed pattern to be duplicated with the building blocks; and a support fixture, containing a first elongate member having a pair of elongated surfaces, one of which is recessed from the other to form a ledge, and containing holding means for supporting said grid block in a position overlying the recessed surface so as to define a channel. The stand also includes a second elongate member oriented essentially perpendicular to the first member carrying the holding means. In assembled combination, the pattern sheet is fitted within the holding means and an opposed edge is inserted within said defined channel, the surface of the second means serving also to support the sheet. According to the invention, the child may duplicate with blocks the pattern shown on the underlying sheet by assembling the blocks upon the installed grid block alongside the planar surface of the sheet.

In accordance with a more specific aspect of the invention, the second member comprises a first portion containing a channel and a slide member reciprocally movable within said channel, said slide member carrying the holding means whereby the holding means may be varied in distance from said ledge to accommodate different size pattern sheets. Further in accordance with this aspect of the invention, detent means are provided to retain said slide member at a desired position. In accordance with a still further aspect of the invention, said slide member includes a saw-like side edge surface configuration formed with triangular shaped teeth, and the second member contains opposed resilient arms carrying a triangular shaped tooth adapted to fit within the teeth of said saw-like portion so as to retain said second member at a position in the absence of a sufficient force which will cause said resilient member to move outwardly, the force required to move the resilient members being sufficiently greater than the weight of the constructional assembly whereby the assembly may be suspended by means of an eyelet in the movable member.

In accordance with a still further aspect of the invention, the channel member carries on the reverse side thereof a pivotable leg so as to allow the unit to serve as an easel-like stand with which to display the constructed block assembly.

The foregoing objects and advantages of the invention, as well as the structure characterized thereof, including additional modifications and equivalent structure, is better understood by giving consideration to the following detailed description of a preferred embodiment of the invention taken together with the figures of the drawings.

DESCRIPTION OF THE PREFERRED EMBODIMENT

Figure 1:
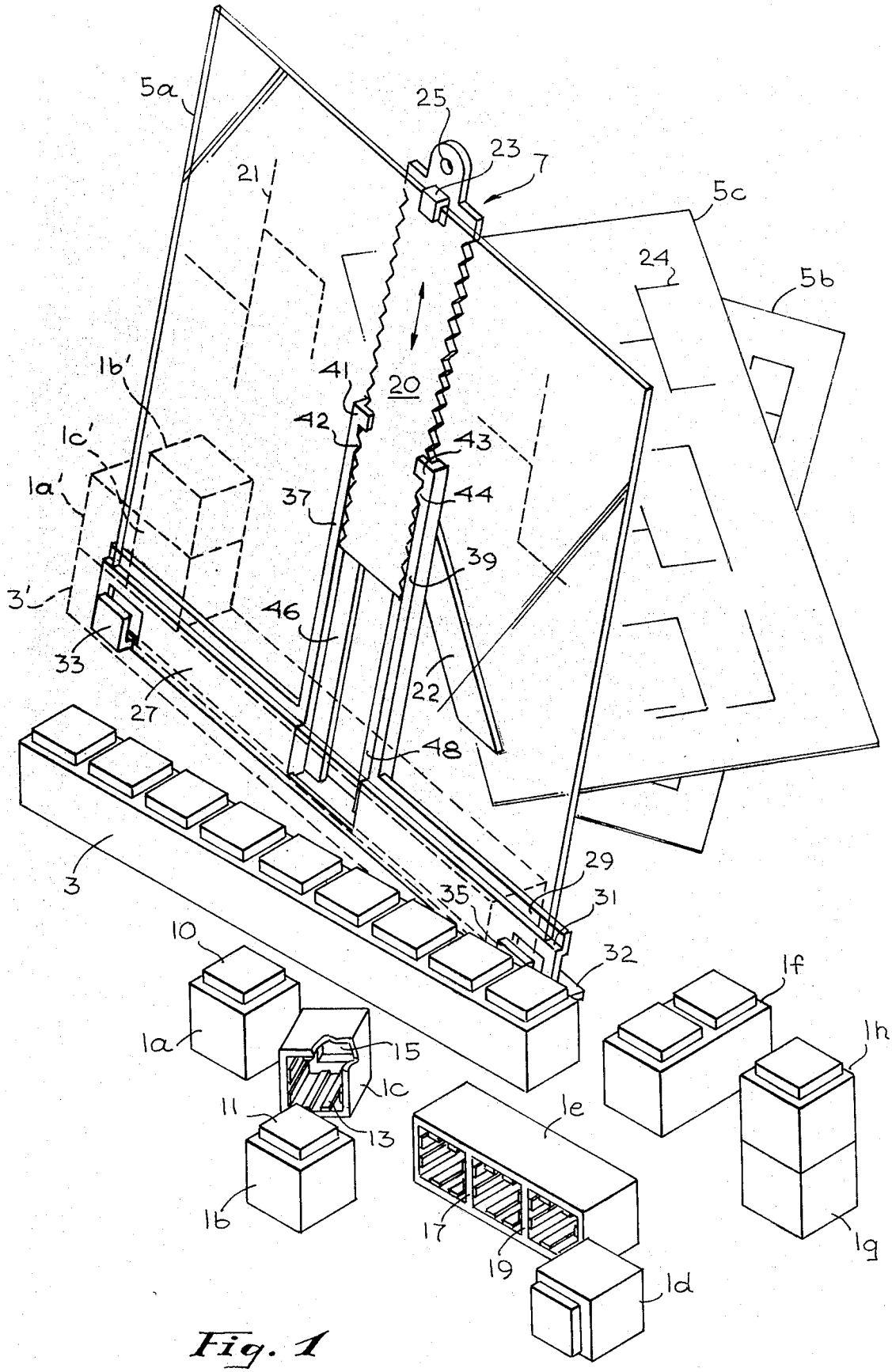
FIG. 1 is a perspective view illustrating a preferred embodiment of the invention.

Reference is made to the preferred embodiment presented in FIG. 1 in which the elements of this constructional toy are arrayed in a perspective illustration. The invention includes a plurality of hollow blocks, 1*a*, 1*b*, 1*c*, 1*d*, 1*e*, 1*f*, 1*g* and 1*h*, a grid block 3, a relatively stiff sheet material 5*a*, illustrated as transparent, 5*b* and 5*c*, and a support member 7, each of which is dealt with hereafter in greater detail.

As illustrated, the support 7 holds the sheet 5*a* in a position underlying the blocks, represented by "invisible" lines and identified by the same numbers with a prime superscript to reveal the relationship between these elements.

The blocks are of a resilient plastic material formed into shape by means of any conventional molding process. Considering blocks 1*a*, 1*b* and 1*c* in the foreground, they are seen to be of identical six-faced cube-like geometry in which the top side contains a protrusion 10 and 11, of square shape geometry. Block 1*c* is turned over to disclose an open bottom side, a hollow cavity of square cross-section within the interior of the block, thin resilient side walls and a pair of upwardly extending straight ribs 13 on the inner surfaces of each side wall, and the protrusion described in respect to blocks 1*a* and 1*b* with which block 1*c* is identical, appears in the interior as a rectanguloid dome 15. Suitably, the distance between the outer surfaces of the opposed ribs on opposite side walls may be essentially equal to or slightly less than the distance between the side surfaces of the protrusions on the blocks, such as on blocks 1*a* and 1*b*. That relationship between the geometry and dimension of the protrusions and internal ribs allows the blocks to be mated in a friction fit with the protrusion on a block extending into the hollow cavity, gripped lightly on the side by the outer surfaces of the ribs in the block with which it is joined, as is shown in the coupled relationship of blocks 1*g* and 1*h*.

Suitably, the resilience of the side walls allows the blocks to give when necessary due to manufacturing tolerances and increase slightly the strength of the friction fit. A double sized block, 1*f*, contains two protrusions on the upper surface and is equivalent in length to two of the blocks, 1*a* and 1*b*. Block 1*e* shown upended in the figure is a triple size block which in length is equal to three of the blocks 1*a*, and this block contains three evenly spaced protrusions on its upper surface, not visible in the figure, each protrusion identical in structure with the protrusions on all of the other interlocking blocks. Each of the doubled sized, triple sized, and multiple sized blocks contains a hollow interior which is divided into compartments by partition walls, such as 17 and 19 in block 1*e*. And each of these partition walls includes pairs of straight extending ribs on opposite wall surfaces facing corresponding straight ribs on an opposed wall or partition wall which permits the block to frictionally interlock with the protrusions on any other of the blocks. Other types of intercoupling means for enabling stacking of the blocks may be substituted in this combination.

The blocks may be of a number of different colors to permit them to be intercoupled in a variety of patterns or artistic designs and an ample supply and variety of these blocks are provided in a single kit with which to practice the invention.

Diverging briefly, although cubic and rectangular blocks are shown for relatively squared shaped printed patterns, it is clear that some blocks may be modified to contain sockets for supporting other structures. Moreover, blocks of other shapes forming angles and curves, though not illustrated, may be incorporated within a pattern. Such types of interlocking blocks contain the square shaped rib structure with which to enable them to intercouple, with the protrusion on top of one of the cubic or rectanguloid blocks illustrated in FIG. 1.

Sheets 5*a*, 5*b* and 5*c* are constructed of a suitable relatively stiff material, such as heavy paper stocks, cardboard or bristol board. Each contains an artistic design or pattern printed on the front surface, as represented by 21 and 24, respectively, on 5*a* and 5*c*, which design or pattern may be assembled or duplicated with the aforedescribed blocks. Additional sheets containing additional patterns, not illustrated, may be provided as is contemplated as a practical matter in toys furnished with the invention.

A particularly long block, 3, which was referred to earlier as the grid block, is equal in size in this embodiment to nine of the smallest size cubic blocks. The grid block is of a construction that is the same in principle as that described for the other multiple sized blocks. That is, the grid block includes nine protrusions, a hollow interior with ribs along the walls, and partition walls. The ribs are spaced and sized to grip the protrusions of another block.

Consider next the structure of support fixture 7 which contains a first elongate section which extends horizontally in the figure to form a base upon which the grid block 3 is supported, as represented in invisible lines 3', and contains a second elongate section oriented at a right angle to the base which contains a recessed channel and is attached integrally at one end thereto, presenting in plan view a generally inverted T-shaped geometry. A third strip-like slide member 20 is carried by the second member within the channel and is reciprocally positionable therewithin, hereinafter described in greater detail. As shown, slide member 20 carries a protruding hook-like tab 23 which functions as a retaining means for an end of sheet 5*a*, represented in invisible lines, and a hook-receiving eyelet 25. A leg 22 is pivotally mounted to the rear of the second member.

The horizontally extending base section of support fixture 7 is suitably approximately equal in length to grid block 3. This base member contains two flat surfaces, 27 and 29, one of which is recessed slightly from the other with a narrow ledge 31 therebetween. An extending bottom rim portion 32 is joined along an edge to the bottom edge of the first surface. A pair of protruding upwardly extending hook-like tabs, 33 and 35, each of which is of a width to fit over the ribs in any block, are attached to first surface 27 suitably formed integrally therewith, and are spaced apart a distance between the first and last cavity sections of the grid block 3 to thereby provide two points of support for the grid block.

Figure 3:
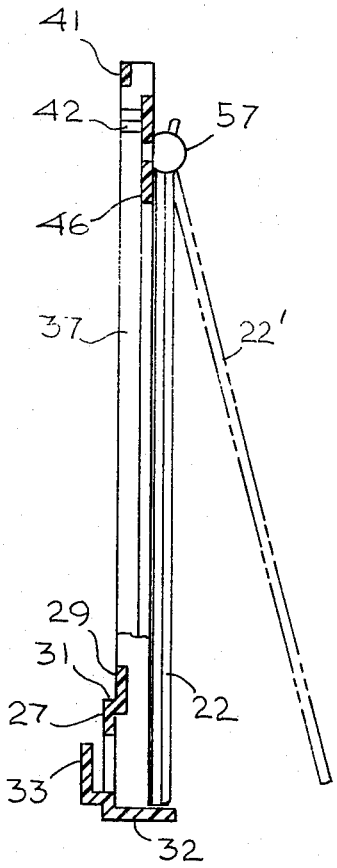
FIG. 3 is a section view of the element of FIG. 2 taken along the line 3—3.
Figure 2:
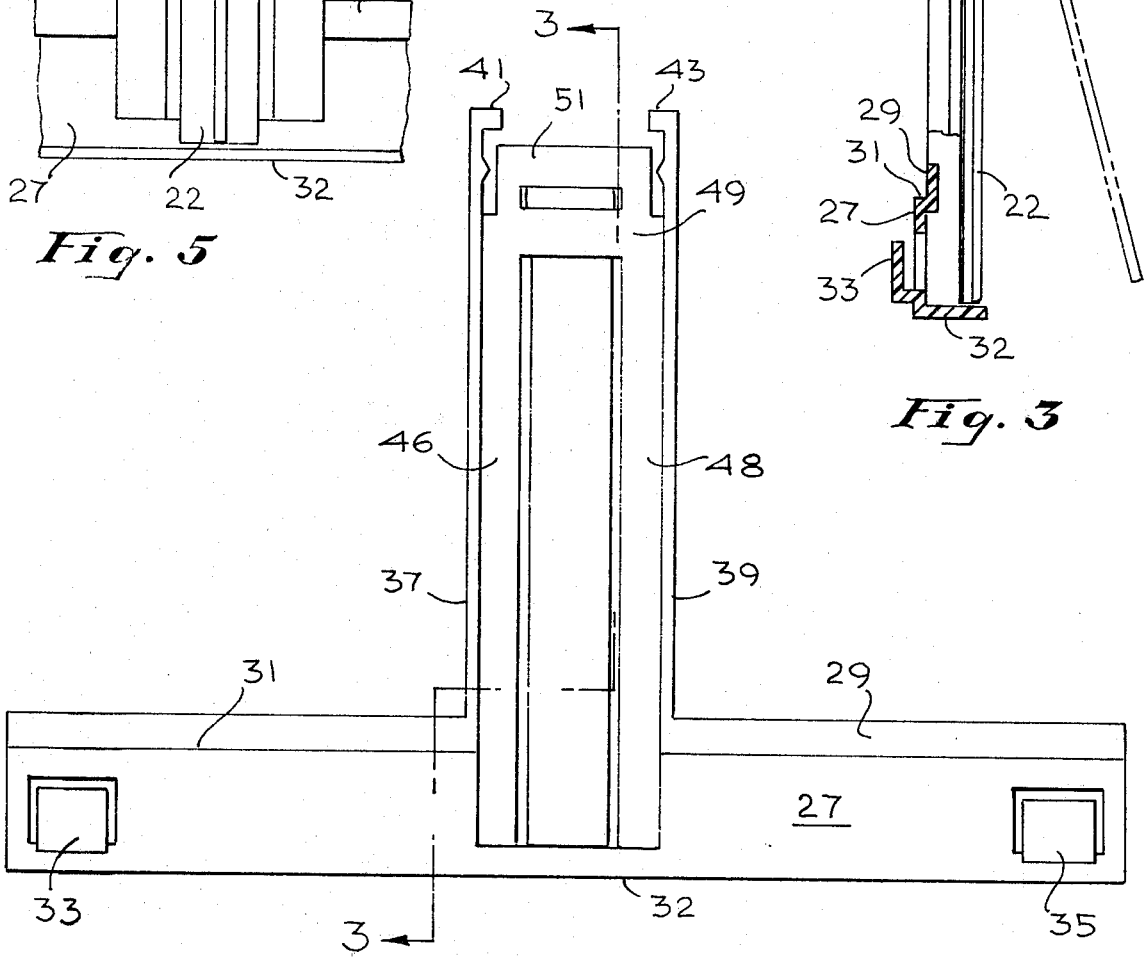
FIG. 2 is a front plan view of an element of the embodiment of FIG. 1.

To illustrate more precisely this relationship with grid block 3, reference is made to FIG. 3 which shows in section a side view of the base member taken along the lines 3—3. FIG. 2, which in turn is a front plan view of the support fixture of FIG. 1 and in which identical elements are identically labeled. As illustrated, the hook-like tab 33 supports the grid block so that a portion of the side wall of grid block 3' abuts the first surface 27 of the base section and the remaining portion of the grid block's side wall overlies the second surface 29 of the base member. As is apparent, the overlying side walls of the grid block, the second surface and ledge 31 of the base member, as assembled, forms an elongate narrow slot or channel within which to receive a bottom edge of pattern sheet 5*a*, as illustrated in FIG. 1 to which reference is made.

The vertical second section of support fixture 7 in FIG. 1 contains two spaced apart parallel side rails, 37 and 39, of narrow depth and width that extend from the recessed surface of the first horizontal section a predetermined length. The front surface of these rails is essentially flush and co-planar with that recessed surface 29. At the upper end, each of these rails carries a protruding square tab 41 and 43. These tabs are of a thickness less than that of the rail and protrude a short distance beyond the rail. Additional like tabs may be provided at a lower position on each of the rails, to retain the slide member 20 in place.

As illustrated, the tabs of the two rails are oriented facing one another. Additionally, each of rails 37 and 39 contains a protruding triangular shaped tooth, 42 and 44, located just below the corresponding tab, that functions as a frictional latch or detent member, as later explained. Each tooth extends downwardly from the front surface of the rail essentially to the depth of the rail and the tooth on one rail is oriented facing that supported by the opposed rail.

Figure 4:
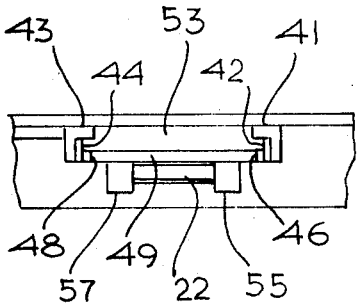
FIG. 4 is an end view of the element in FIG. 2 taken from the top.

For ease of understanding of this portion of the second member, it is convenient to make reference in addition to FIG. 4, which is a top plan view of the support fixture with the slide member 20 omitted and in which identical elements are identically labeled.

As seen in FIG. 1, strip-like members 46 and 48 have exposed flat surfaces and are integrally attached to respective corresponding ones of the side rails. The upper surfaces of these strips are recessed from the upper surfaces of the rails. The narrow strip members extend from a location just below the associated tooth on the corresponding rail to almost the plane of the bottom rim 32 of the first horizontal section. This leaves the upper end of the rails which carry the detent teeth and the tab to define cantilever arms which, through the inherent resilience of the plastic material of which they are formed, may be pushed out laterally a short distance and will spring back to normal position when released (See FIG. *7a* and FIG. *7b*).

Brief reference is again made to the section view of FIG. 3, which shows this element taken along the lines 3—3 in FIG. 2, for added understanding. As viewed from the side, tab 41 and tooth 42 carried by rail 37, as well as the surface of strip 46 recessed from the top surface of rail 37, reveal the relative geometry, dimension and relationship of the described elements.

A bridging member 49 joins strip 46 and 48 as well as affords a spacing brace for the ends of the rails. The bridging member includes a shaft support element 51 viewed from the rear for the pivotable leg 22, earlier briefly referenced. In essence, the arrangement forms a narrow shallow channel. It is noted that the shaft support member 51 has its side ends spaced from the end of the teeth and that the surface of same is co-planar with strips 46 and 48. The width of this member 51 is narrow enough so that it does not restrict operational movement of the arm ends of rails 37 and 39.

As viewed in the end view of a portion of this element in FIG. 4, the spacing between the under surfaces of tabs 41 and 43, and the surface of the strips 46 and 48, provides a narrow slot 53 through which to introduce the movable slide member 20 into the formed channel, and the strips 46 and 48 provide a guide and support surface for same.

Figure 5:
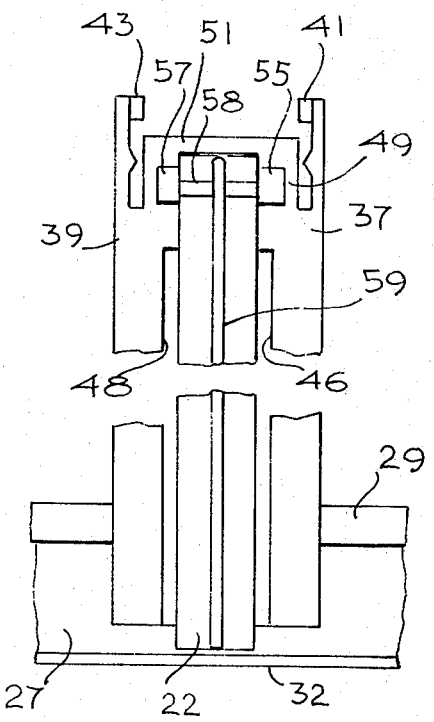
FIG. 5 is a partial rear view of the element of FIG. 2.

Viewing in FIG. 5 the reverse side of the fixture presented in FIG. 3, the second member supports two bearings, 55 and 57, within which to receive and pivotally support the integral shaft 58 of pivotable leg 22. The leg includes a longitudinally extending rib 59 to ensure rigidity and the small portion above shaft 58 formed at a small angle to the plane of the leg, such as 30 degrees. When the leg is pivoted outward to its maximum extent, the movement is limited by the bent portion which swings into abutment with the rear surface of the support member. This is illustrated by the positions of leg 22 in the view of FIG. 3 and in its extended position as 22'.

Preferably all of the parts of support fixture 7 are formed in a unitary assembly of resilient plastic material using a mold and a conventional injection molding process. The pivotable leg may be separately formed and inserted into place on the second support member.

Figure 6:
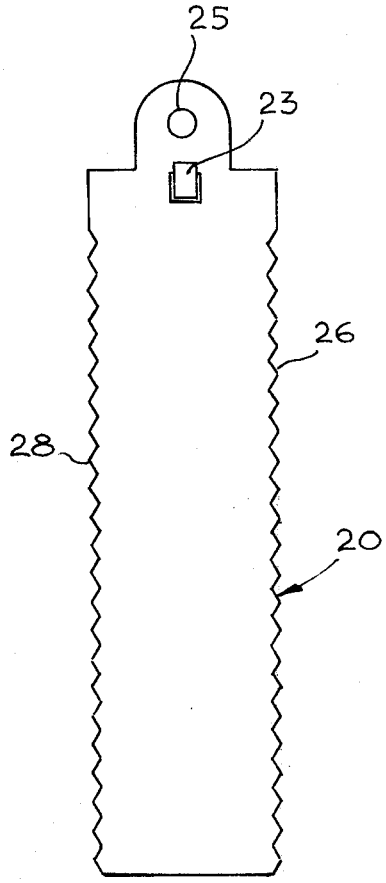
FIG. 6 is a front plan view of the slide member used in the embodiment of FIG. 1.
Figure 7A:
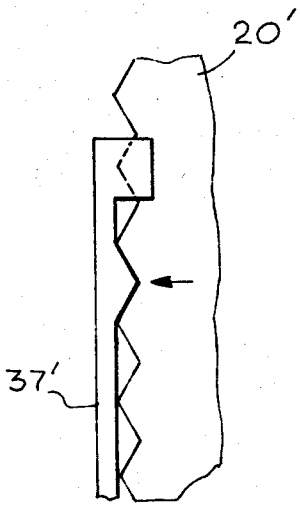
FIGS. 7*a* and 7*b* are pictorial illustrations disclosing the mode of operation of a detent employed in the embodiment of FIG. 1.
Figure 7B:
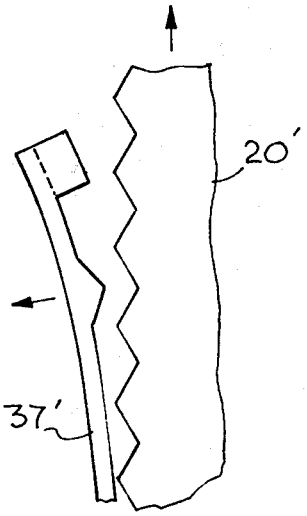

As is depicted in FIG. 1 and briefly alluded to previously, the second vertical section of fixture 7 includes an adjustably positionable slide member 20 which is situated between rails 37 and 39 in the channel formed therebetween, and is reciprocally positionable therein, vertically with respect to the horizontal section, to different vertical positions. This slide member is illustrated separately in the plan view of FIG. 6. The slide member is a thin strip of plastic material, thin enough to fit between the under surface of tabs 41 and 43 within the formed slot 53, visible in the end view of FIG. 4. It is of a width greater than the distance between the detent teeth 42 and 44 which inwardly protrude into the formed channel.

The right and left hand side edges, 26 and 28, of slide member 20 are saw-like in geometry over a major portion of the member's length. This consists of a series of uniform spaced triangular teeth with an apex angle suitably about 45 degrees to about 90 degrees. The member's upper end contains an eyelet opening 25 and a hook-like tab 23 that projects from the front surface of the slide and extends a short distance toward the lower end. The eyelet opening serves as a hanger by means of which the support fixture may be held upright by a picture hook and the tab serves as a retainer for holding the upper end of a sheet, such as sheet 5*a* illustrated in FIG. 1.

The slide member may be inserted into position within the channel through slot 53 to position the carried retainer tab 23 at a desired distance from ledge 31 and retainer tabs 33 and 35 formed on the horizontal fixture section as is illustrated in FIG. 1. As the slide member is pushed into or withdrawn from the channel, the saw edges act as a camming surface engaging and pushing teeth 42 and 44 and arm ends outwardly out of the space between teeth, illustrated pictorially in FIGS. *7a* and *7b*, and as the member is withdrawn further the spring-like resilience of the arms 37 and 39 carries the detent tooth back into the next space between teeth on the slide member. This action continues until the slide is positioned by the user. At such position, the opposed teeth engage opposed spaces in the corresponding edge, as in FIG. *7a*, and prevent the slide from moving. In effect, the relationship is that of a releasible frictional detent which serves to release when the slide is pushed or pulled with a sufficient force, but does not release if subjected to a force due solely to the weight of the slide and grid block or, as becomes apparent, due to the weight of the slide and an assembled toy block structure.

At this point the reader is fully acquainted with the elements comprising the invention and of the relationship between the elements thereof. Considering next one use of same as presented in FIG. 1, the child selects any pattern sheet, which as supplied may come in a variety of heights, containing a pattern or design which the child wishes to duplicate, illustrated as sheet 5*a*. The child installs grid block 3 onto the horizontal section of the support fixture, where it is held by retainer tabs 33 and 35 and forms the narrow sheet receiving channel. The child inserts sheet 5*a* into the channel and then adjusts the position of slide member 20 so that the carried retainer 23 holds the upper end of the sheet. The child then selects blocks from the supply of blocks, 1*a* through 1*h* for example, interlocking them together to duplicate the pattern design. This may be done with the fixture flat or held in an easel-like standing manner with leg 22 moved outward supporting the fixture upright in a tilted position. At the conclusion of that effort, the child withdraws the pattern sheet by sliding out one side or the other and returns the sheet to the supply. The assembled block structure may remain on the support fixture with the support fixture in a standing position for display. Alternatively, the fixture with the assembled blocks may be suspended from a picture hook or nail on a house wall to display the child's work in that manner. As was previously described, the weight of the blocks is insufficient to force the detent to release so that slide 20 remains in position even though the entire assembly is suspended by the eyelet 25.

The preferred manner of use heretofore described obviously is not intended to limit the child's ingenuity and is not intended as all inclusive of the possible uses of the invention. Nor is the described use intended to be inclusive of all combinations in which the invention may be manifested. It is appreciated that the elements of the invention may form but a part of a larger constructional toy kit containing other elements and structures which may be used with or independently of the present invention as may be desired.

It is believed that the foregoing description of a preferred embodiment of the invention is described in such detail as is sufficient to enable one skilled in the art to make and use same. However, it is expressly understood that the invention is not to be limited to those details presented for the foregoing purpose, inasmuch as other equivalent elements which suggest themselves to those skilled in the art upon reading this specification may be substituted for same, as well as additions or improvements thereto, all of which embody the invention herein described. Accordingly, it is respectfully requested that the invention be broadly construed within the full spirit and scope of the appended claims.

What is claimed is:

1. A construction toy which includes:

(a) a plurality of interconnectable blocks for coupling with one another to form an easily assemblable and disassemblable stacked structure;

(b) a planar sheet containing a printed pattern, said pattern defining a structure assemblable for said blocks;

(c) an elongate grid block having means on its top interlockable with the blocks of said plurality;

(d) support fixture means for holding said planar sheet and said elongate grid block in a relationship with a side wall of said grid block extending along and in part overlying a bottom portion of the pattern-carrying surface of said planar sheet;

(d1) an elongate horizontally extending base section containing two longitudinally extending surfaces recessed from one another and a narrow ledge therebetween;

(d2) retainer means for holding said grid block upon said base in a position in which said grid block overlies said ledge to define between said block, ledge and one of said recessed walls, a slot for receiving one edge of said planar sheet;

(d3) second retainer means located spaced from said first retainer means and said formed slot for holding an opposed edge of said planar sheet;

whereby a structure defined by said printed pattern may be assembled from said building blocks on top of said grid block and in overlying relation to said pattern.

2. The invention as defined in claim 1 wherein said support fixture means further comprises:

a second elongate section coupled to said base section and extending perpendicular thereto, said second section forming a channel;

reciprocally positionable slide means located partially within said channel; and releasable detent means for holding said slide means in a set position in said channel; and wherein said second retainer means is carried by said slide means;

whereby said support means can be adjusted to hold different size planar sheets.

3. The invention as defined in claim 2 wherein said releasable detent means comprises a frictional releasable detent means releasable upon application of a force greater than a force exerted by the combined weight of the elements comprising said assembled structure, said sheet, and said support fixture means;

whereby said assembly may be suspended from said slide means.

4. The invention as defined in claim 2 further comprising:

a pivotable leg; and means for pivotally coupling said leg to a rear side of said second section of said support fixture means; said leg being for supporting said support fixture means in an upstanding tilted position.

5. The invention as defined in claim 2 wherein at least two of said plurality of interconnectable blocks comprise:

a hollow thin-walled body of resilient plastic material defining a generally cubic structure having an open side to expose an inner cavity and a top wall opposed to said open side containing an outwardly protruding portion of generally square shaped cross-section and a pair of longitudinally extending spaced parallel ribs protruding from each wall adjacent said open side and extending to said open side, the ribs on one wall arranged confronting the corresponding ribs on an opposed wall to define a series of protrusions about the inner cavity; and wherein the protruding portion of one block fits within the hollow of the other block and is frictionally contacted on each side by a portion of the ribs thereof.

6. A construction toy which includes:

(a) a set of interconnectable blocks capable of intercoupling with one another to form a structure;

(b) support means for supporting said structure comprising:

(b1) a first horizontally extending portion forming a base;

(b2) a second elongate portion extending substantially perpendicular to said first portion and defining a channel;

(b3) an adjustable positionable slide member positionable in said channel, comprising:

an elongated thin strip containing a saw tooth edge geometry on each of the right hand and left hand edges;

first and second resilient plastic arms supported in cantilever manner at one end located on the right hand and left hand side of said strip;

each of said arms carrying a protruding generally triangular shaped tooth oriented facing the edge of an adjoining one of said strips and engaging in the space between teeth in said edge;

whereby movement of said strip causes the teeth on said strip edge to force said arms and carried teeth outwardly and the resilience of said arms restores said teeth to the next space in between teeth located confronting said carried teeth by continued movement of said strip;

(b4) retaining means located on said slide member whereby said retaining means may be positioned vertically relative to said first horizontally extending portion forming a base.

7. The invention as defined in claim 6 wherein said set of interconnectable blocks further comprises:

(c) an elongate grid block for intercoupling with and supporting other blocks of said set of blocks;

(d) retainer means located on said base for supporting said grid block.

8. The invention as defined in claim 7 further comprising:

(e) a pattern sheet containing a pattern of a structure assemblable from said set of blocks;

said pattern sheet being supported by said support means and having an upper edge held by said retainer means of said slide member.

9. The invention as defined in claim 8 wherein said horizontally extending portion defining said base further comprises:

a horizontally extending narrow ledge;

wherein said retaining means supports said grid block in a position at least partially overlying said ledge to form a narrow channel on said base; and wherein a bottom edge of said pattern sheet is positioned in said narrow channel on said base.

10. The invention as defined in claim 6 wherein said slide member contains an eyelet passage at an upper end.

11. The invention as defined in claim 6 further comprising:

a pivotable leg; and means for pivotally mounting said leg to a rear surface of said second elongate portion underlying said channel.

* * * * *